US010537822B2

(12) United States Patent
Leclercq et al.

(10) Patent No.: US 10,537,822 B2
(45) Date of Patent: Jan. 21, 2020

(54) SCENERY-MANOEUVRING APPARATUS

(71) Applicant: HUCHEZ TREUILS, Ferrieres (FR)

(72) Inventors: Mathieu Leclercq, Amiens (FR); Alexandre Dechamps, Crevecoeur-le-Petit (FR)

(73) Assignee: HUCHEZ TREUILS, Ferrieres (FR)

( * ) Notice: Subject to any disclaimer, the term of this patent is extended or adjusted under 35 U.S.C. 154(b) by 0 days.

(21) Appl. No.: 16/323,162

(22) PCT Filed: Aug. 4, 2017

(86) PCT No.: PCT/EP2017/069861
§ 371 (c)(1),
(2) Date: Feb. 4, 2019

(87) PCT Pub. No.: WO2018/024904
PCT Pub. Date: Feb. 8, 2018

(65) Prior Publication Data

US 2019/0184303 A1 Jun. 20, 2019

(30) Foreign Application Priority Data

Aug. 4, 2016 (FR) ..... 16 57578

(51) Int. Cl.
*A63J 1/02* (2006.01)
*A63J 5/00* (2006.01)

(52) U.S. Cl.
CPC ..... *A63J 1/02* (2013.01)

(58) Field of Classification Search
CPC ..... A63J 1/00; A63J 1/02; A63J 1/028; A63J 5/00; A63J 5/12
USPC ..... 472/75–80; 212/316, 318; 248/320, 325, 248/328, 331
See application file for complete search history.

(56) References Cited

U.S. PATENT DOCUMENTS

| | | | | |
|---|---|---|---|---|
| 4,606,527 | A * | 8/1986 | Ziller | A63J 1/028 254/336 |
| 5,492,236 | A * | 2/1996 | Foy | A63J 5/12 212/318 |
| 5,711,713 | A * | 1/1998 | Krueger | A63J 1/028 472/77 |
| 6,855,063 | B2 * | 2/2005 | Murphy | A63J 1/028 16/93 R |
| 7,886,920 | B2 * | 2/2011 | Colley | A63J 5/12 212/316 |
| 8,814,119 | B2 * | 8/2014 | Boychuk | A63J 1/028 16/400 |
| 2002/0082096 | A1 * | 6/2002 | Walker | A63J 1/02 472/75 |
| 2011/0042634 | A1 | 2/2011 | Boychuk | |

FOREIGN PATENT DOCUMENTS

| | | |
|---|---|---|
| FR | 2 799 455 A1 | 4/2001 |
| JP | S53 129498 U | 10/1978 |
| JP | 2001 233589 A | 8/2001 |

* cited by examiner

*Primary Examiner* — Kien T Nguyen
(74) *Attorney, Agent, or Firm* — Muncy, Geissler, Olds & Lowe, P.C.

(57) ABSTRACT

The apparatus for moving a load includes a carrier cable having a first end connected to the load, and a second end connected to a movement device, the movement device including an operating line connected to a movement carriage. An electric motor is configured to move the carriage as a function of a force exerted on the operating line.

16 Claims, 4 Drawing Sheets

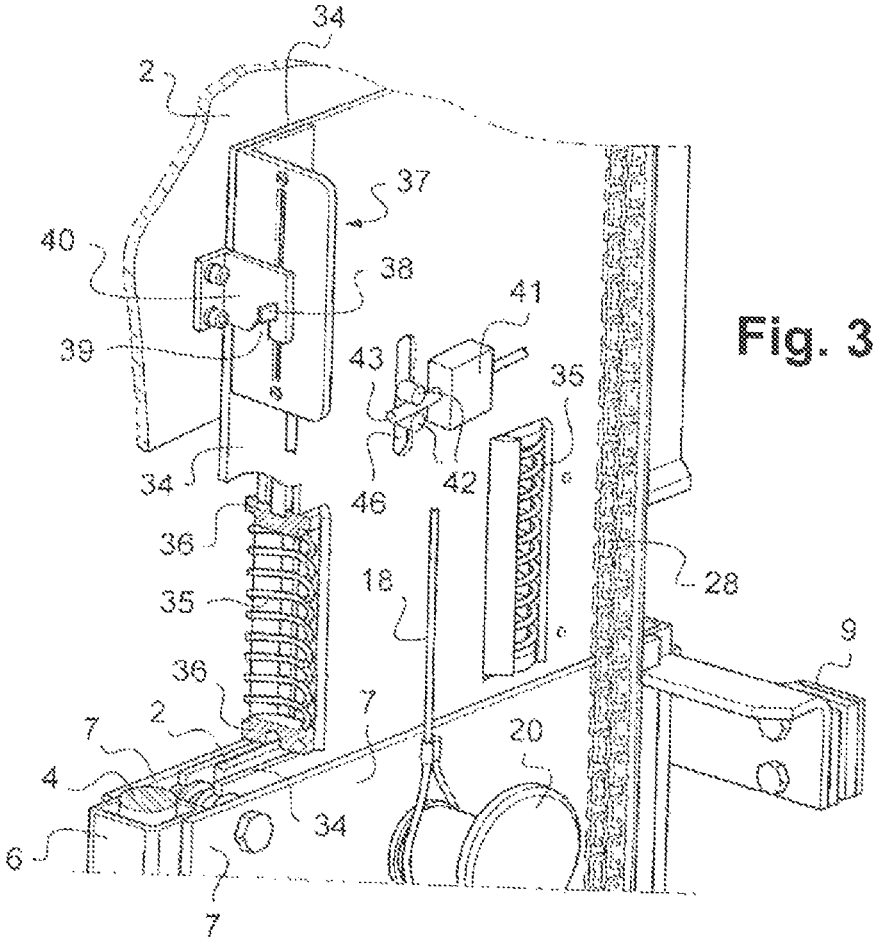
Fig. 3
Fig. 4
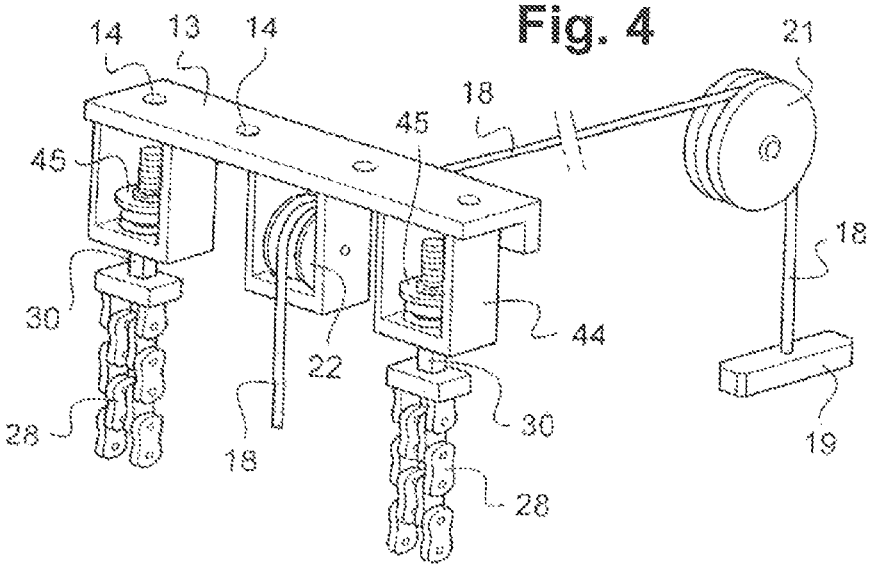

SCENERY-MANOEUVRING APPARATUS

The present invention relates to apparatus for moving a load, and more particularly but not exclusively, to apparatus for moving theatre scenery.

BACKGROUND OF THE INVENTION

In order to change the scenery in a theatre, it is common practice to use moving apparatus comprising an operating line having its end fastened to a carriage that is connected to the load by a carrier cable. With theatre scenery, the apparatus has a plurality of carrier cables, each having one end connected to the carriage, with their opposite ends being connected at various points to a beam carrying the scenery. In order to make moving easier, it is known to use counterweights that are fastened to the carriage and that are of weight equal to the weight of the load. That structure makes it easy to move the load manually by means of the operating line. Nevertheless, when it is necessary to change scenery of given weight, for other scenery of weight that is different from that of the preceding scenery, it is necessary to adapt the counterweight correspondingly so that the counterweights and the load have the same weight. That operation is arduous and requires several people to be present.

In order to avoid that drawback, it is known to replace the operating line and its counterweight with an electric motor that is fastened to the floor. Nevertheless, the weight of a piece of theatre scenery can be very high (up to 300 kilograms (kg)), such that replacing counterweights by an electric motor involves using an electric motor of large size, which is generally not compatible with the space available, and which is of high cost.

OBJECT OF THE INVENTION

An object of the invention is to provide apparatus for moving a load that can easily be adapted to variation in the weight of the load, while complying with the space available.

BRIEF SUMMARY OF THE INVENTION

In order to achieve this object, there is provided an apparatus for moving a load relative to a carrier structure, the apparatus comprising a carrier cable having a first end connected to the load, and a second end connected to a movement device. The movement device includes: an electric motor and a carriage that is mounted to move relative to the carrier structure and that is configured to move relative to the carrier structure during rotation of the motor; an operating line having its two ends connected via respective attachment points to the carriage so as to form a loop around two pulleys mounted on the carrier structure; and a control member associated with a member for measuring movement of the attachment point relative to the carriage in order to control rotation of the electric motor as a function of that movement.

In an advantageous version of the invention, the electric motor has an outlet shaft carrying at least one drive sprocket wheel co-operating with at least one roller chain. Also preferably, the apparatus includes deflector sprocket wheels arranged on either side of the drive sprocket wheel in order to press the roller chain against the drive sprocket wheel along a sinuous path.

In a preferred embodiment of the invention, the electric motor is carried by the carriage.

Like the other elements carried by the carriage, the electric motor acts as a counterweight.

Preferably, the apparatus includes an additional counterweight carried by the carriage. For equal performance of the electric motor, this increases the load capacity of the apparatus.

Furthermore, in certain circumstances, in particular in the theatre, it is preferable for the personnel in charge of putting scenery into place to become familiar with the new equipment as quickly as possible. In particular, it is desirable for structure of the apparatus to be as close as possible to the structure of prior apparatus, and for the force to be delivered for moving scenery to be as close as possible to the force that used to be delivered with prior equipment.

In another aspect of the invention, the carriage is movably mounted on reference member including the attachment points, the control member for controlling the electric motor issuing a control signal as a function of the relative position of the carriage and of the reference member.

In a preferred version of the invention, the apparatus includes a resilient member fastened both to the reference member and to the carriage, and configured to return the reference member and the carriage to a neutral position relative to each other in which the control signal is zero.

According to another advantageous aspect of the invention, the apparatus comprises a sensor for detecting the relative position of the reference member and of the carriage, and for causing the electric motor to rotate as a function of the signal delivered by the sensor. Preferably, the sensor is a potentiometer having a slider having a zero point at the middle of the stroke of the slider and delivering opposite voltages on either side of the zero point. Also preferably, the device includes a snap-opening switch that opens when the reference member and the carriage pass through the neutral position.

In another aspect of the invention, the movement measurement member comprises a first angular position sensor associated with one of the two pulleys of the operating line, and a second angular position sensor associated with a return pulley of the carrier cable or with an outlet shaft of the electric motor in order to detect the relative position between the reference member and the carriage.

In another aspect of the invention, the movement measurement member comprises a bidirectional strain gauge extending between an attachment point of the operating line and the carriage.

Advantageously, the movement measurement member comprises two strain gauges, each extending between one of the two attachment points of the operating line and the carriage.

BRIEF DESCRIPTION OF THE DRAWINGS

Other characteristics and advantages of the invention appear further on reading the following description of a preferred, but non-limiting embodiment of the invention given with reference to the accompanying figures, in which:

FIG. 3 is an enlarged fragmentary view of the box III of FIG. 2;

FIG. 4 is an enlarged fragmentary view of the box IV of FIG. 1;

DETAILED DESCRIPTION OF THE INVENTION

Figure 1:
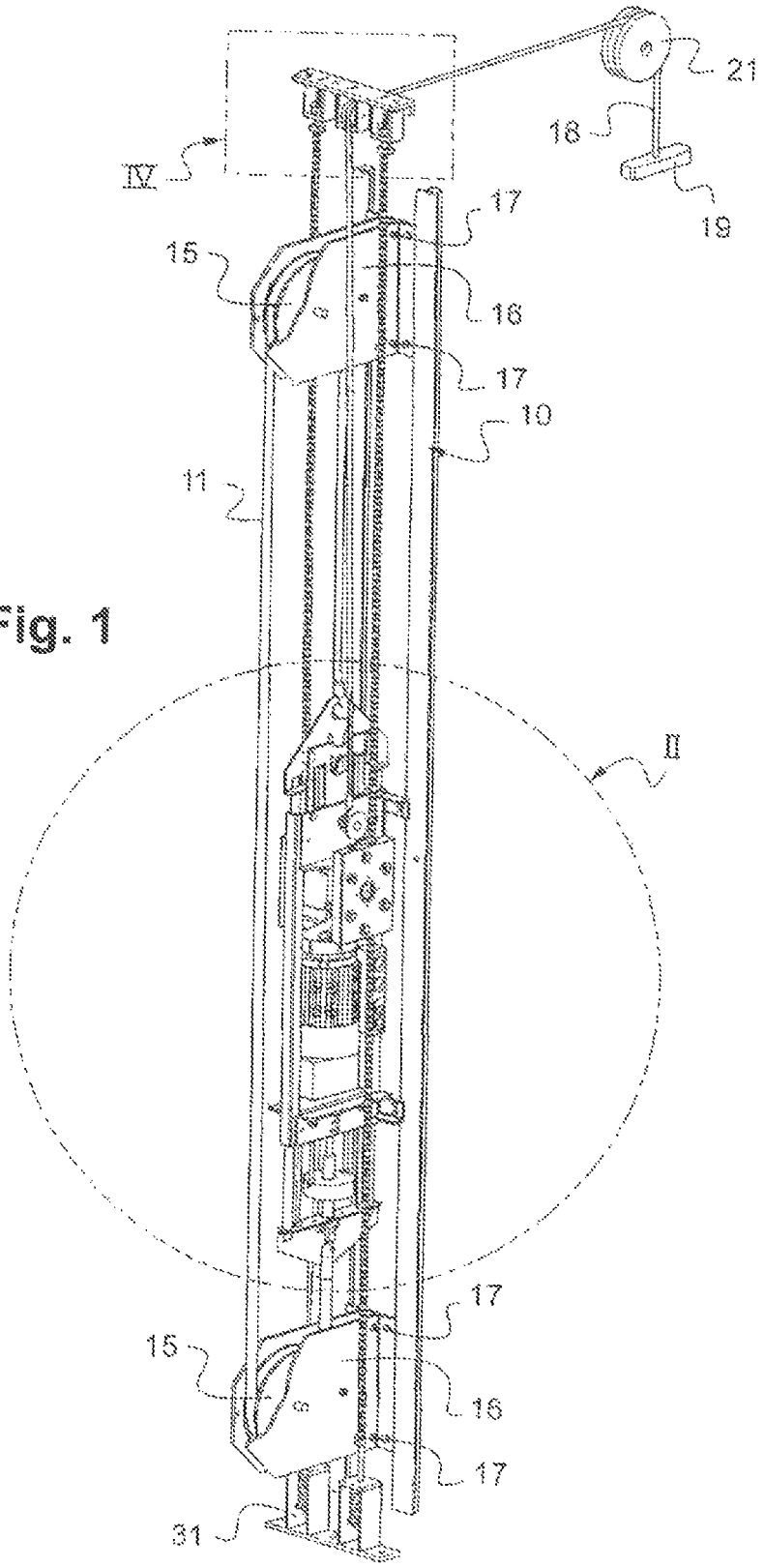
FIG. 1 is a perspective view of moving apparatus in a first embodiment of the invention.
Figure 2:
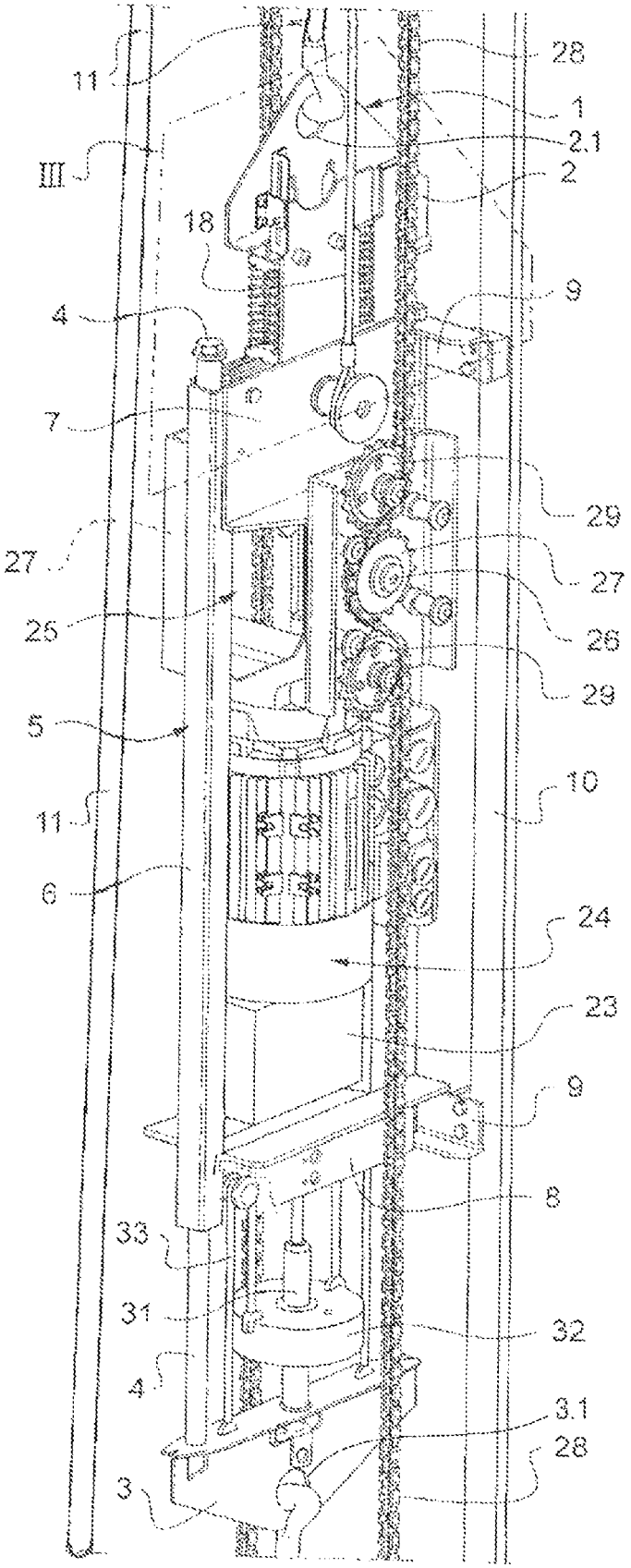
FIG. 2 is an enlarged and partially cutaway perspective view of the circular box II of FIG. 1.

With reference to FIGS. 1 to 4, the moving apparatus in the first embodiment of the invention comprises a reference member 1 that comprises a top plate 2 and a bottom plate 3 that are connected to each other by tie-rods 4.

An operating line 11 has one end connected to an attachment point 2.1 of the top plate 2 and an opposite end connected to an attachment point 3.1 of the bottom plate 3. At both ends of the loop formed in this way, the operating line passes over a pulley 15 that is carried to rotate freely by cheekplates 16 having holes 17 for fastening them to the wall. In a variant, the bottom pulley 15 need not be fastened to the wall so that the weight of said pulley exerts tension on the operating line 11.

The apparatus includes a movement device comprising a carriage 5 mounted to slide relative to the reference member 1 by means of tubes 6 engaged on the tie-rods 4. The carriage 5 also has two plates 7 fastened to the tubes 6 on either side of the plate 1 and two plates 8 fastened to the tubes 6 and supporting a counterweight 23. The carriage 5 also has forks 9 engaged astride on a guide rail 10 that is fastened to the wall.

Carrier cables 18, only one of which is shown in the figures, each have one end connected to a load 19, in this example a segment of a carrier beam, and an opposite end attached to a stud 20 carried by the plate 7 and passing over a deflector pulley 21 fastened in conventional manner vertically relative to the load 19 and over a deflector pulley 22 carried by an angle bar 13. In order to balance loads, the carriage preferably has two studs 20, one on each main face of the carriage 5.

Furthermore, the movement device includes an electric motor 24 carried axially by the carriage 5 (i.e. the electric motor 24 has a rotor of axis that extends parallel to the sliding direction of the carriage 5). The electric motor 24 is associated with reduction gearing 25 having an outlet shaft 26 that extends perpendicularly to the axis of the carriage 5 and that has each of its ends carrying a respective drive sprocket wheel 27 having a roller chain 28 engaged thereover. This serves to balance the forces to which the outlet shaft 26 is subjected. The roller chain 28 is held engaged on the drive sprocket wheel 27 along a sinuous path by means of idler sprocket wheels 29. This makes it possible for the force to which the drive sprocket wheel is subjected while it is being rotated by the motor 24 to be shared over a plurality of teeth.

Threaded rod segments 30 are fastened to the top end of the roller chain 28. The threaded rod segments 30 pass through the bottom portions of brackets 44 fastened to the angle bar 13. The roller chains 28 are tensioned by nuts 45 screwed onto the threaded rod segments 30 and bearing against the bottom portions of the brackets 44. At their bottom ends, the roller chains 28 are fastened to a plate that is fastened to the floor by using mounting analogous to that used at their top ends. The angle bar 13, the plate 31, and the roller chains define a carrier structure.

A counterweight 23, which adds to the weight of the motor 24 and of the other elements carried by the carriage 5, is fastened to the plate 8 in order to compensate in part for the weight of the load, e.g. a counterweight of 150 kg for a load of 300 kg. A damper 31 is fastened to the reference member 1 and also to the carriage 5 so as to damp relative movements between the reference member 1 and the carriage 5. A counterweight 32 for balancing the weight of the reference member is mounted to slide on the body of the damper 31 and is held suspended by flexible ties 33 fastened both to the counterweight 32 and to the plate 3, passing over deflector pulleys carried by the carriage 5.

The reference member 1 and the carriage 5 are returned towards a neutral position by a resilient member, in this example two helical springs 35, each carried by cups 36 engaged in the ends of the springs. Furthermore, the cups 36 bear against the edge of a window in the plates 2, and on the edges of identical windows in the plates 34 that are secured of the plates 7 on either side of the plates 2 so that the springs 35 are put into compression regardless of the travel direction of the reference member and of the carriage relative to each other.

The device also has an electronic unit associated with a linear potentiometer 37 fastened to one of the plates 34. The potentiometer 37 has a neutral point at half-stroke and inverting circuits on either side of the neutral point. It has a slider 38 engaged in an opening 39 of a plate 40 fastened to the plate 2 of the reference member 1.

A snap-opening switch 41 is also mounted on the plate of the carriage 5 and has a control toggle 43 of position that is controlled by a fork 42 carried by the plate 2 of the reference member 1 and passing through a slot 46 in the plate 34. The control toggle 43 is movable between a neutral position in which the switch 41 is open, and an upwardly or downwardly tilted position in which the switch 41 is closed.

Starting from the position shown in FIG. 1 in which the assembly comprising the carriage and the reference member is in its low position and the load is high, downward traction exerted on the front strand of the operating line 11 gives rise, as a result of compressing the spring 35, to upward movement of the reference member 1 relative to the carriage 5. The relative movement between these two components is measured by the position of the cursor of the potentiometer 37, thereby triggering rotation of the electric motor 24 in the direction for raising the assembly comprising the carriage and the reference member.

In conventional manner, the signal delivered by the potentiometer 37 may be interpreted as a setpoint for position, for speed, or for acceleration. When moving theatre scenery, the preferred setpoint that is used is an acceleration setpoint since that is a closer match to earlier mechanical devices.

The setpoint for moving continuously exists so long as the user exerts a force on the line that causes the springs to be compressed. The value of the setpoint is proportional to the force exerted.

If the user holds the operating line 11 stationary, the movement of the carriage 5 naturally brings the potentiometer 37 and the switch 41 back towards the neutral position.

If the user lets go of the operating line 11, it is the springs 35 that act to return the potentiometer 37 and the switch 41 towards the neutral position.

The damper 31 serves to avoid this return movement being too violent and ensures that it takes place without bouncing.

When the neutral position is reached and the carriage 5 has stopped or is moving at low speed, the electricity is switched off and the brake of the electric motor 24 is applied.

Figure 5:
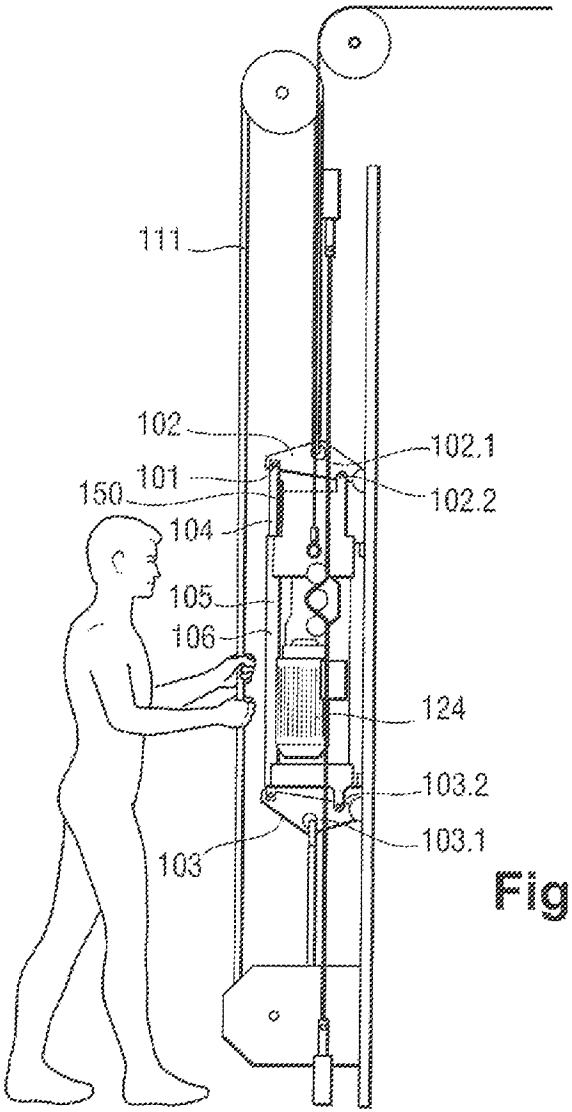
FIG. 5 is a diagrammatic view of moving apparatus in a second embodiment of the invention.

FIG. 5 shows a second embodiment of the invention that, like the above embodiment, relates to apparatus for moving a load relative to a carrier structure. The movement apparatus shown in FIG. 5 is similar to that shown in FIGS. 1 to 4 with the exception that the reference member in this embodiment is hinged.

The movement apparatus thus has a reference member 101 having a top plate 102 and a bottom plate 103 that are connected together by a single tie-rod 104, and each of which is connected to the carriage 105 via a pivot hinge 102.2, 103.2 so as to form a deformable parallelogram. The top plate 102 and the bottom plate 103 are weighted behind their pivot points 102.2, 102.2 in order to balance their weights.

More precisely, an operating line 111 has one end connected to an attachment point 102.1 of the top plate 102 and an opposite end connected to an attachment point 103.1 of the top plate 103. The apparatus includes a movement device comprising the carriage 105 mounted to slide along the tie-rod 104 of the reference member by means of a tube 106 engaged on said tie-rod. The apparatus also has an electric motor 124 carried by the carriage 105 and arranged in identical manner to the above-described first embodiment.

A strain gauge 150 is mounted between the carriage and the tie-rod 104 in order to measure the rectilinear relative movements between the reference member and the carriage and thus control rotation of the electric motor as a function of this movement.

Figure 6:
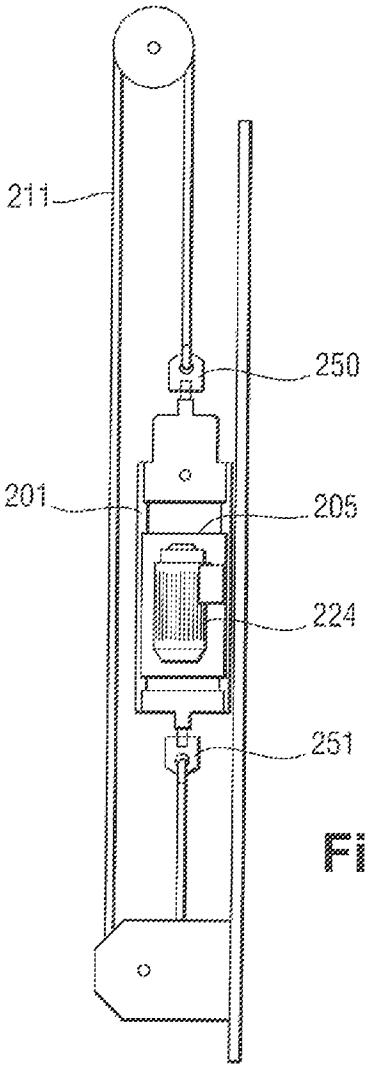
FIG. 6 is a diagrammatic view of moving apparatus in a third embodiment of the invention.

FIG. 6 shows a third embodiment of the invention that is similar to the first embodiment shown in FIGS. 1 to 4, except that the carriage carrying the electric motor in this embodiment is mounted to be stationary relative to the reference member.

Thus, the movement apparatus has a reference member 201 connected at one end to an operating line 211 via a first strain gauge 250 and connected at an opposite end to the operating line 211 via a second strain gauge 251. A carriage 205 is mounted stationary relative to the reference member 201 and carries an electric motor 224.

Downwardly exerted traction on the operating line 211 causes the first strain gauge 250 to deform, which then delivers a signal causing the electric motor 224 to be operated in a direction to cause the assembly comprising the carriage and the reference member to move upwards. Conversely, upwardly exerted traction on the operating line 211 causes the second strain gauge 251 to be deformed, which delivers a signal causing the electric motor 224 to be rotated in a direction for lowering the assembly comprising the carriage and the reference member.

Naturally, the invention is not limited to the embodiment described and variant embodiments may be applied thereto without going beyond the ambit of the invention as defined by the claims.

Although the invention is described with reference to moving theatre scenery, the invention applies to any device for moving a load. The symmetrical operation of the force compensation motor makes it possible to use a counterweight to increase the load capacity of the system.

Although the invention is described with a motor assembly comprising an electric motor associated with a roller chain, the invention may be implemented with any motor assembly.

Although the invention is described with the carriage sliding relative to the reference member, the invention may be implemented with parts that are hinged relative to one another.

The invention may include additional control means, in particular manual control means, and for example pushbuttons or a remote control. These additional control means may also include a computer unit controlling the motor with a programmed sequence.

Although in the first embodiment of the invention relative movement between the reference member and the carriage is measured by the slider 38 of a potentiometer 37, it is also possible to determine this movement, e.g. by using firstly a first angular position sensor associated with one of the pulleys 15 of the operating line in order to measure the movement of the reference member, and secondly a second angular position sensor associated with one of the deflector pulleys 21, 22 of the carrier cable 18 or with the outlet shaft 26 of the electric motor in order to measure the movement of the carriage 5. Simple comparison between the measurements taken by the first and second angular position sensors serves to determine the relative movement between the reference member and the carriage.

Another solution for measuring the relative movement of the reference member and the carriage may also be to use a bidirectional strain gauge connecting the attachment point 2.1 of the operating line to the carriage. The sensor used for detecting the movements of the attachment point may be of any type suitable for measuring movements that are relatively large (such as the movement of the carriage relative to the reference member) or relatively small (such as the deformation of the part carrying the attachment points). The sensor may be a digital sensor.

The sensor may be any force sensor that delivers a signal that can be used for controlling the motor.

In an embodiment in which the electric motor is stationary, the movement device is preferably a looped line having its ends fastened to the reference member, and the carriage is preferably driven by a chain that has ends fastened to the carriage in order to form a loop around deflection gearwheels that mesh with an outlet gearwheel of the stationary motor.

The invention claimed is:

1. An apparatus for moving a load relative to a carrier structure, the apparatus comprising a carrier cable having a first end connected to the load, and a second end connected to a movement device, the apparatus wherein the movement device includes an electric motor and a carriage that is mounted to move relative to the carrier structure and that is configured to move relative to the carrier structure during rotation of the motor, in that the device includes an operating line having its two ends connected via respective attachment points to the carriage so as to form a loop around two pulleys mounted on the carrier structure, and in that the device includes a control member associated with a member for measuring movement of the attachment point relative to the carriage in order to control rotation of the electric motor as a function of that movement.

2. The apparatus according to claim 1, wherein the electric motor has an outlet shaft carrying at least one drive sprocket wheel co-operating with at least one roller chain.

3. The apparatus according to claim 2, including deflector sprocket wheels arranged on either side of the drive sprocket wheel in order to press the roller chain against the drive sprocket wheel along a sinuous path.

4. The apparatus according to claim 1, wherein the electric motor is carried by the carriage.

5. The apparatus according to claim 4, including an additional counterweight carried by the carriage.

6. The apparatus according to claim 1, wherein the carriage is movably mounted on reference member including the attachment points, and in that the control member for controlling the electric motor issues a control signal as a function of the relative position of the carriage and of the reference member.

7. The apparatus according to claim 6, including a resilient member fastened both to the reference member and to the carriage, and configured to return the reference member and the carriage to a neutral position relative to each other in which the control signal is zero.

8. The apparatus according to claim 6, wherein the movement measurement member comprises a sensor for detecting the relative position of the reference member and of the carriage, and for causing the electric motor to rotate as a function of the signal delivered by the sensor.

9. The apparatus according to claim 8, wherein the sensor is an analog sensor.

10. The apparatus according to claim 9, wherein the sensor is a potentiometer having a slider having a zero point at the middle of the stroke of the slider and delivering opposite voltages on either side of the zero point.

11. The apparatus according to claim 10, including a snap-opening switch that opens when the reference member and the carriage pass through the neutral position.

12. The apparatus according to claim 6, including a damper (31) mounted between the reference member and the carriage.

13. The apparatus according to claim 6, wherein the movement measurement member comprises a first angular position sensor associated with one of the two pulleys of the operating line, and a second angular position sensor associated with a return pulley of the carrier cable or with an outlet shaft of the electric motor in order to detect the relative position between the reference member and the carriage.

14. The apparatus according to claim 6, wherein the movement measurement member comprises a bidirectional strain gauge extending between an attachment point of the operating line and the carriage.

15. The apparatus according to claim 6, wherein the reference member comprises a bottom plate and a top plate connected to each other by a tie-rod, and each connected to the carriage via a pivot hinge, the carriage being mounted to slide along the tie-rod.

16. The apparatus according to claim 1, wherein the movement measurement member comprises two strain gauges, each extending between one of the two attachment points of the operating line and the carriage.

* * * * *